US007412970B2

(12) United States Patent
Apel et al.

(10) Patent No.: US 7,412,970 B2
(45) Date of Patent: Aug. 19, 2008

(54) CYLINDER HEAD FOR A DIRECT INJECTION INTERNAL COMBUSTION ENGINE

(75) Inventors: Christian Apel, Weissach (DE); Frank Dieterle, Ditzingen (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 275 days.

(21) Appl. No.: 11/363,321

(22) Filed: Feb. 28, 2006

(65) Prior Publication Data

US 2006/0196478 A1 Sep. 7, 2006

(30) Foreign Application Priority Data

Mar. 1, 2005 (DE) ..... 10 2005 009 118

(51) Int. Cl.
*F02M 61/14* (2006.01)

(52) U.S. Cl. ..... 123/470; 123/509

(58) Field of Classification Search ..... 123/470, 123/509, 508, 507, 469, 468, 456, 73 A
See application file for complete search history.

(56) References Cited

U.S. PATENT DOCUMENTS 4,290,394 A * 9/1981 Frank et al. ..... 123/73 A
5,899,190 A * 5/1999 Nakagomi et al. ..... 123/470
6,269,798 B1 * 8/2001 Takahashi et al. ..... 123/470
6,405,713 B1 * 6/2002 Scollard et al. ..... 123/468
6,640,784 B1 * 11/2003 Sims, Jr. ..... 123/470
7,086,385 B2 * 8/2006 Imoehl ..... 123/470
7,178,508 B2 * 2/2007 Shioiri et al. ..... 123/470
2002/0029762 A1 3/2002 Scollard et al.

FOREIGN PATENT DOCUMENTS

EP 0775820 B1 11/1996
EP 0 751 290 A1 1/1997
EP 1 493 916 A1 1/2005

* cited by examiner

*Primary Examiner*—Carl S Miller
(74) *Attorney, Agent, or Firm*—Crowell & Moring LLP

(57) ABSTRACT

A cylinder head for a direct-injection internal-combustion engine, has injection valves accommodated in openings in the cylinder head and secured in pairs by a respective fastening element formed as a hold-down device on the cylinder head. The hold-down device has two holding or fastening arms for the injection valves and is fastened to the cylinder head by way of a central fastening point. At the two ends of the hold-down device, dome-type receiving devices for a fuel connection piece of the injection valve are provided. The connection piece is at least radially elastically disposed in the receiving device.

10 Claims, 3 Drawing Sheets

CYLINDER HEAD FOR A DIRECT INJECTION INTERNAL COMBUSTION ENGINE

This application claims the priority of DE 10 2005 009 118.0, filed Mar. 1, 2005, the disclosure of which is expressly incorporated by reference herein.

BACKGROUND AND SUMMARY OF THE INVENTION

The present invention relates to a cylinder head for a direct-injection internal-combustion engine and, more particularly, to a cylinder head having injection valves which are accommodated in openings in the cylinder head and are secured in pairs by one fastening element respectively constructed as a hold-down device on the cylinder head, the hold-down device having two holding or fastening arms for the two injection vales and being fastened to the cylinder head by way of a central fastening point.

Hold-down devices for fuel injection valves of direct-injection internal-combustion engines are known, for example, from EP 0 775 820 B1. Such hold-down devices are fastened by a central fastening point at the cylinder head, and by way of their two holding arms, press two fuel injection valves into the opening provided in the cylinder head. The fuel lines connected to the injection valves permit static as well as dynamic forces to be exercised upon the injection valves during the operation of the internal-combustion engine. Vibrations caused by internal and external influences should be absorbed to a certain degree by the hold-down devices as well as the injection valves.

It is therefore an object of the invention to fasten the fuel injection valves by a corresponding hold-down device fastening arrangement in an operationally reliable and durable manner at or in the cylinder head. Loads acting upon the injection valve are to be reduced.

This object has been achieved by dome-type receiving devices constructed on the two arms of the hold-down device, in which the connection piece of the fuel injection valve is in each case elastically disposed. As a result, a durable and operationally reliable fastening of the fuel injection valves at the cylinder head is ensured—despite the occurring vibrations. Furthermore, the dynamic and static loads upon the injection valves are reduced.

The two dome-type receiving devices of the hold-down device each have an opening in which a section of the fuel connection piece is form-lockingly received. The form-locking receiving is used for supporting the screw-down torque of swivel nuts for fuel feed lines which are screwed onto the fuel connection piece of the injection valve.

In order to be able to compensate possible position tolerances of the two fuel injection valves in the direction of the cylinder axis (Z-axis), the central fastening of the hold-down device on the cylinder head has devices for the tolerance compensation according to the so-called balance arm principle.

For the tolerance compensation of the two injection valves in the Z-direction, a central opening is made in the hold-down device, in which opening a distance bush is received through which a fastening screw is guided which is screwed to the cylinder head. Coaxially to the distance bush, a spring element is received in a central recess of the hold-down device, which spring element, compressed by way of the head of the fastening screw, is supported on the bottom of the central recess.

The spring element is constructed as a cup spring or as stack of cup springs. The hold-down device is constructed as an aluminum casting. In addition to weight advantages, the casting can within certain limits dampen vibrations introduced by way of the fuel feeding system.

In order to permit an angular alignment of the fuel injection valves to the combustion chamber, the valve body of the injection valve accommodated in the opening of the cylinder head has a seat surface provided with a bevel, which seat surface interacts with an intermediate ring consisting, for example, of plastic material or high-grade steel. The intermediate ring is inserted in the opening for the injection ring constructed as a step-type bore.

On the side interacting with the seat surface of the valve body, the intermediate ring is provided with a crowned surface. This permits a tolerance compensation in the direction of the Y-axis according to the principle of a pivoting bearing.

Other objects, advantages and novel features of the present invention will become apparent from the following detailed description of the invention when considered in conjunction with the accompanying drawings.

DETAILED DESCRIPTION OF THE DRAWINGS

Figure 3:
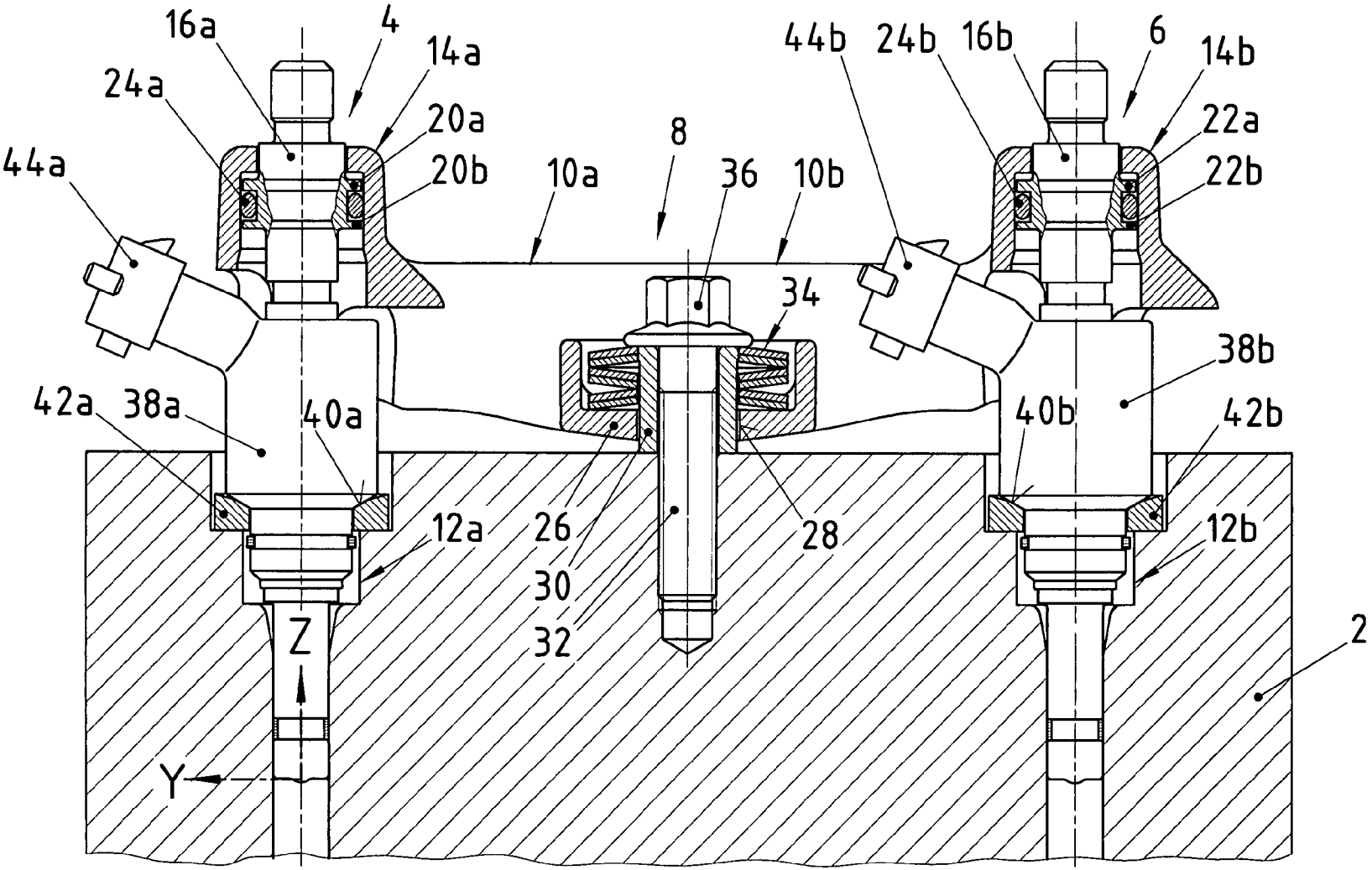
FIG. 3 is a longitudinal sectional view of the cylinder head in the area of the fuel injections valves.

For the fastening of the fuel injection valves 4, 6, shown in FIG. 3, a fastening element constructed as hold-down device generally designated by numeral 8 is provided on the cylinder head 2 of a direct-injection multi-cylinder internal-combustion engine. The device 8 holds down the two injection valves 4, 6 by way of its two holding arms 10*a*, 10*b*, again shown in FIG. 3, against the combustion pressure acting in the operation of the internal-combustion engine in receiving openings 12*a*, 12*b* provided in the cylinder head 2. At the end of the two holding arms 10*a*, 10*b*, the hold-down device 8 has two dome-type receiving devices 14*a*, 14*b* for the fuel connection piece 16*a*, 16*b* of the injection valve 4, 6.

The receiving devices 14*a*, 14*b* each have an opening 18*a*, 18*b*, in which the fuel connection piece 16*a*, 16*b* is form-lockingly accommodated. For this purpose, the openings 18*a*, 18*b* and the connection pieces 16*a*, 16*b* each have two straight lateral surfaces and two lateral surfaces constructed in the shape of a circular arc. The straight lateral surfaces of the openings 18*a*, 18*b* are used for supporting the screw-down torque applied to the connection piece 16*a*, 16*b*, which is generated when individual fuel lines are fastened by a swivel nut on the connection piece 16*a*, 16*b*.

The connection piece 16*a*, 16*b* of the injection valve 4, 6 disposed in the receiving device 14*a*, 14*b* has two mutually spaced surrounding webs 20*a*, 20*b* and 22*a*, 22*b* respectively between which one O-ring 24*a*, 24*b* respectively is accommodated. As illustrated in FIG. 3, the O-ring 24*a*, 24*b* is used for the radial support with respect to the dome-type receiving device 14*a*, 14*b* of the hold-down device 8. It simultaneously contributes to the damping of vibrations which are transmitted to the injection valves 4, 6. Furthermore, the O-rings 24*a*, 24*b* are used as a protection against loss for the injection valves 4, 6 which, for the preassembly, are fitted into the receiving devices 14*a*, 14*b* of the hold-down device 8.

The hold-down device 8 has a central circular recess 26 in whose center a passage opening 28 is provided. In the passage opening 28, a distance bush 30 is received through which a fastening screw 32 for the hold-down device 8 which is screwed to the cylinder head 2 is guided. Coaxially to the distance bush 30, a stack of cup springs 34 is arranged in the central recess 26. The cup springs 34, in the mounted condition, are compressed by the head 36 of the fastening screw 32. For a better representation of the cup springs, FIG. 3 shows their position in the non-compressed condition. As a result of this type of fastening, different installation positions of the injection valves 4, 6 caused by manufacturing tolerances can be compensated in the direction of the Z-axis.

The valve body 38*a*, 38*b* of the injection valve 4, 6 accommodated in the opening 12*a*, 12*b* of the cylinder head 2 has a seat surface 40*a* and 40 provided with a bevel. Each seat surface 40*a*, 40*b* is supported by a respective intermediate ring 42*a*, 42*b* in the receiving opening 12*a*, 12*b* constructed as a step-type bore. The side of the intermediate ring 42*a*, 42*b* interacting with the seat surface 40*a*, 40*b* of the valve body 38*a*, 38*b* has a crowned surface by way of which an angular alignment becomes possible with respect to the Y-axis.

Figure 1:
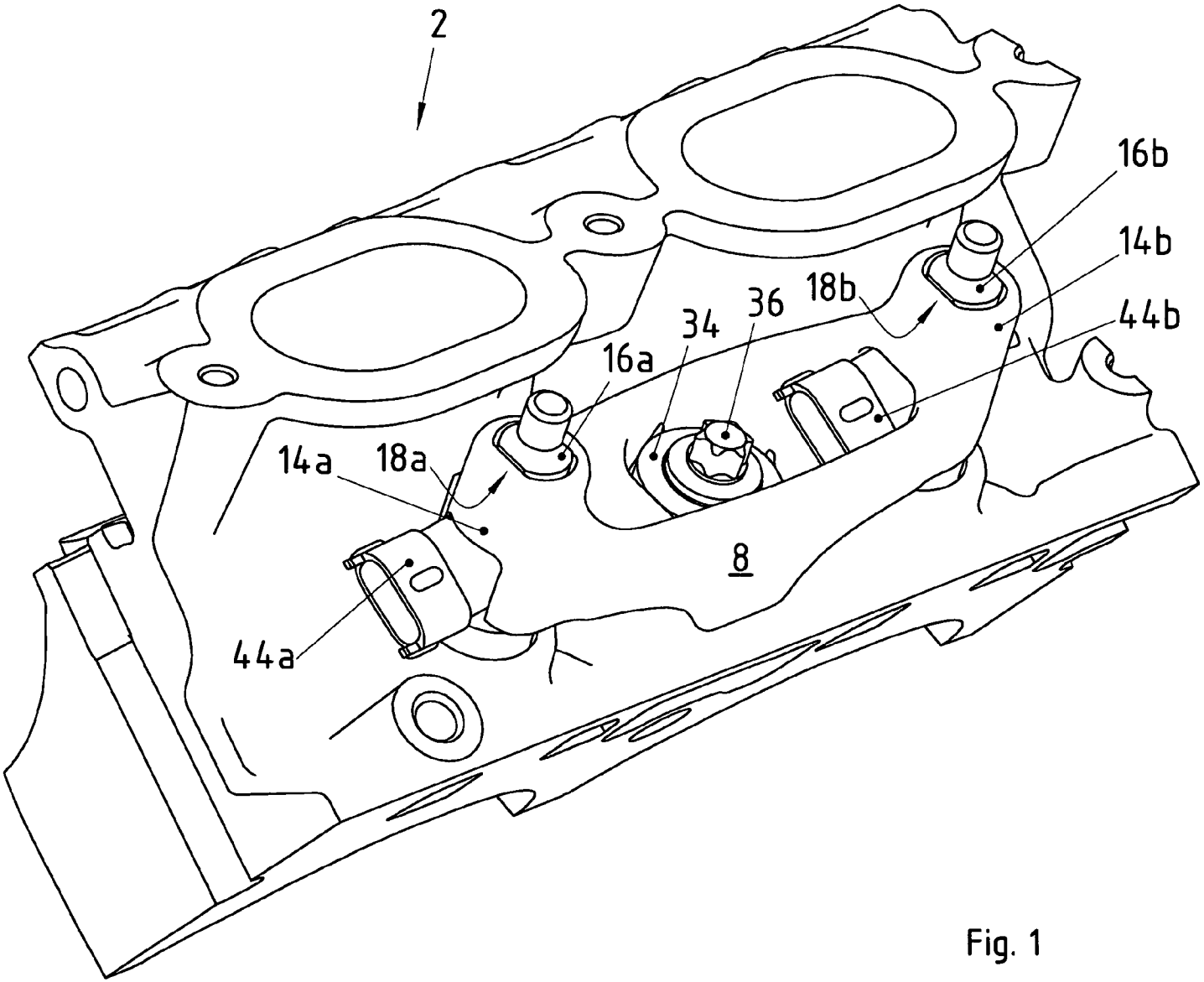
FIG. 1 is a perspective view of a cutout of a cylinder head with fuel injection valves.
Figure 2:
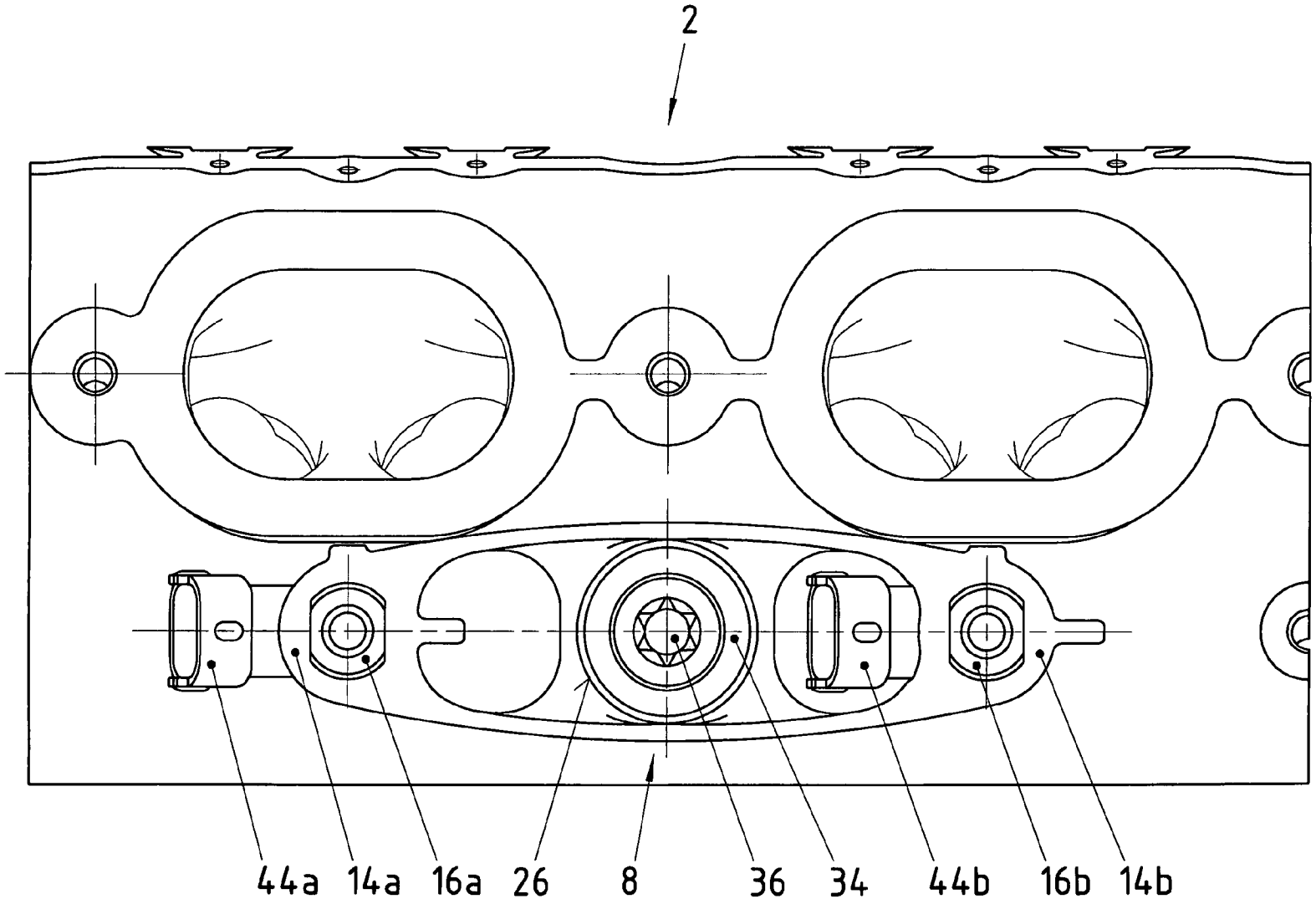
FIG. 2 is a top view of the section of the cylinder head shown in FIG. 1.

The hold-down device 8 for the two fuel injection valves 4, 6 is produced from an aluminum casting. As further illustrated in FIGS. 2 and 3, electrical contact connections 44*a* and 44*b* are provided on the respective valve body 38*a*, 38*b*, for electromagnetically controlling the valve needles disposed in the injection valves 4, 6.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Cylinder head arrangement for a direct-injection internal-combustion engine, comprising injection valves operatively accommodated in cylinder head openings and secured in pairs by a respective fastening configured as a hold-down device, wherein the hold-down device has arms for the associated injection valves and is operatively fastened at a central cylinder head fastening point, wherein dome-type receiving devices configured for a respective fuel connection piece of the respective valves are provided at ends of the hold-down device, and the respective connection piece is at least radially elastically disposed in the associated one of the receiving devices.

2. Cylinder head arrangement according to claim 1, wherein an opening is provided in each receiving device to form-lockingly accommodated accommodate a fuel connection piece section therein.

3. Cylinder head arrangement according to claim 1, wherein the central cylinder head fastening point for the hold-down device includes tolerance compensation capability for different installation positions of the injection valves in a Z-axis direction.

4. Cylinder head arrangement according to claim 3, wherein an opening is provided in the each receiving device to form-lockingly accommodate a fuel connecting piece section therein.

5. Cylinder head arrangement according to claim 3, wherein the hold-down device includes a central opening in which a distance bush is received for guiding a fastening screw screwable to the cylinder head, and, coaxially to the distance bush, a central recess is arranged for accommodating a spring element, which is compressible by the fastening screw and is supported at a bottom of the central recess.

6. Cylinder head arrangement according to claim 5, wherein the spring element comprises a cup spring.

7. Cylinder head arrangement according to claim 5, wherein the spring element comprises a stack of cup springs.

8. Cylinder head arrangement according to claim 1, wherein the hold-down device is an aluminum casting.

9. Cylinder head arrangement according to claim 1, wherein a body of the injection valves on the cylinder head opening of the cylinder head each have a seat surface provided with a bevel which interact with an intermediate ring in a step-bore opening.

10. Cylinder head arrangement according to claim 9, wherein a side of the intermediate ring which interacts with the valve body seat surface, has a crowned configuration.

* * * * *